US006250780B1

(12) United States Patent
Minissi et al.

(10) Patent No.: US 6,250,780 B1
(45) Date of Patent: Jun. 26, 2001

(54) INDOOR LUMINAIRE ASSEMBLY

(75) Inventors: Paolo E. Minissi, Austin, TX (US); Jack L. Ries, Granville, OH (US)

(73) Assignee: NSI Enterprises, Inc., Newark, OH (US)

( * ) Notice: Subject to any disclaimer, the term of this patent is extended or adjusted under 35 U.S.C. 154(b) by 0 days.

(21) Appl. No.: 09/343,999

(22) Filed: Jun. 30, 1999

(51) Int. Cl.[7] ..... F21V 17/00

(52) U.S. Cl. ..... 362/364; 362/147; 362/339; 362/348

(58) Field of Search ..... 362/147, 328, 362/329, 331, 337, 339, 340, 343, 348, 364, 365, 346

(56) References Cited

U.S. PATENT DOCUMENTS 1,846,813 * 2/1932 Pfeiffer ..... 362/365
2,630,521 * 3/1953 Kirlin ..... 362/364
6,053,625 * 4/2000 Bowker ..... 362/348

* cited by examiner

*Primary Examiner*—Y. Quach

(57) ABSTRACT

An indoor luminaire assembly for installation in a grid ceiling which has a low plenum depth profile and defines a ceiling plane, which includes a frame which is disposed in the grid ceiling and is co-planar with the ceiling plane. Also included is a reflector which is attached to the frame and is disposed substantially above the ceiling plane. The reflector includes a highly specular reflective inner surface which has a relatively high specular reflectance of approximately 95%. A lamp is also included for generating light vertically oriented from the reflector. Further, an optical unit is attached to the frame and has a prismatic refractor which is disposed substantially below the ceiling plane for distributing light therethrough.

4 Claims, 5 Drawing Sheets

INDOOR LUMINAIRE ASSEMBLY

TECHNICAL FIELD

This invention relates to an indoor luminaire assembly or lighting unit.

BACKGROUND ART

Designers of lighting for recessed indoor applications have limited design choices. This is particularly the case when the designer desires a smaller lighting fixture package because the designated recessed lighting environment has a high grid ceiling or a shallow plenum depth between ceiling and adjacent floor joists. Traditionally, fluorescent lighting fixtures have been used in such recessed applications because they generate much less heat than other types of lighting units (such as high intensity discharge luminaires), making them ideal for placement in a high ceiling having a shallow plenum depth. Fluorescent fixtures also typically have horizontally oriented lamps which lie in the plane of the ceiling, usually because any other orientation would lead to visual discomfort and glare due to direct high angle radiation from the lamp, and may require louvers. However, fluorescent fixtures also provide relatively less illumination than other types of lighting fixtures, thereby requiring a greater number of units to achieve the desired lighting effect.

Another type of lighting unit is the high intensity discharge (HID) luminaire, which is often used in outdoor applications. HID units have generally proven unsuitable for indoor applications as they tend to generate a relatively large and undesirable amount of heat, especially in the context of enclosed spaces, such as a grid ceiling, and particularly in those ceilings having a relatively shallow plenum depth. Such fixtures also produce unacceptable glare.

Accordingly, when used indoors, such luminaires have generally used a white coated diffuse reflector and a flat prismatic lens (which lies in the ceiling plane) to help reduce the apparent brightness of the fixture. Unfortunately, the diffuse nature of this type of reflector causes a large reduction in reflector efficiency. Also, the radiant energy emitted by the HID lamp goes through multiple reflection bounces before it exits the luminaire. Because each reflection leads to some degree of absorption of radiation (for example, if reflectance is 80%, then the material absorbs 20% of the energy), this leads to more energy being absorbed by the luminaire housing and hence transmitted to the ceiling structure in the form of heat. Moreover, in traditional HID fixtures, in order to change the lighting distribution it is necessary to change the lamp center and/or the optical unit itself, which can be a time consuming and costly task.

Consequently, an improved luminaire assembly for indoor applications is desired. The improved luminaire assembly should be adapted for use in a high grid ceiling or a ceiling having a shallow plenum depth. The luminaire assembly should have acceptable levels of generated and absorbed heat, brightness and glare control for their designated application. The luminaire should also have relatively high efficiency and reflectance.

DISCLOSURE OF INVENTION

It is an object according to the present invention to provide an improved luminaire assembly for indoor applications.

It is a further object according to the present invention to provide an improved luminaire assembly for use in a high ceiling or a ceiling having a shallow plenum depth.

It is still a further object according to the present invention to provide a luminaire assembly having acceptable heat generation and absorption characteristics and which runs at cooler temperatures.

It is still another object according to the present invention to provide an indoor luminaire assembly having acceptable brightness and glare control.

It is yet another object according to the present invention to provide a luminaire assembly which extends below the plane of the ceiling with a vertically oriented lamp without the high angle radiation or visual discomfort which would typically be associated with the same.

It is a further object according to the present invention to provide an indoor luminaire assembly having improved efficiency.

In carrying out these and other objects and goals according to the present invention, a luminaire assembly is provided which is adapted for use indoors mounted in a ceiling. The luminaire assembly includes a reflector portion which has an inner surface formed of a specular material which has relatively high specular reflectance. The assembly also includes an HID lamp which is disposed within the reflector portion for generating light. It further includes an optical unit which is substantially disposed below a plane defined by the ceiling and has a refractor portion with a prismatic structure for distributing the light in a downward direction. In a preferred embodiment, the reflector portion is formed of an anodized aluminum layer which has the relatively high specular material deposited on the inner surface. In a still more preferred embodiment, the specular material is a Miro 4™ material. In another embodiment, the reflector portion is formed of faceted segments attached to each other, and is preferably formed into a segmented hexagonal shape. The inner surface of reflector portion should have an approximately 95% specular reflectance and the total luminaire assembly efficiency should be in the range between 72–79%. Further, the lamp of this luminaire assembly should project below the plane defined by the ceiling.

In another embodiment, provided is an indoor luminaire assembly for installation in a grid ceiling which has a low plenum depth profile and defines a ceiling plane, which includes a frame which is disposed in the grid ceiling and is co-planar with the ceiling plane. Also included is a reflector which is attached to the frame and is disposed substantially above the ceiling plane. The reflector includes a highly specular reflective inner surface which has a relatively high specular reflectance of approximately 95%. A lamp is also included for generating light vertically oriented from the reflector. Further, an optical unit is attached to the frame and has a prismatic refractor which is disposed substantially below the ceiling plane for distributing light therethrough.

In still another embodiment, an indoor recessed luminaire assembly is provided for installation in a drop ceiling which defines a ceiling plane. The indoor luminaire assembly includes a housing which is oriented above the drop ceiling plane and has a lamp socket, a ballast and a capacitor which are mounted therein. Also included is a lamp received in the lamp socket and vertically disposed therefrom for generating light. The lamp is oriented to project below the ceiling plane. Also included is a frame disposed in the drop ceiling and which is co-planar with the ceiling plane. Further included is a reflector disposed above the ceiling plane and attached to the frame, and which has a relatively high specular reflective inner surface. Also included is a glass prismatic optical unit which is attached to the frame and which is disposed below the plane of the drop ceiling for distributing generated light, such that the indoor recessed luminaire assembly has an efficiency in the range of 72–79%.

The above objects and other objects, features and advantages of the present invention are readily apparent from the following detailed description of the best modes for carrying out the invention when taken in connection with the accompanying drawings wherein like reference numerals correspond to like components.

BRIEF DESCRIPTION OF DRAWINGS

FIG. 3*d* illustrates a typical photometric candlepower distribution curve for a luminaire assembly having a refractor similar to that shown in FIG. 1, with a spread beam reflector;

BEST MODE FOR CARRYING OUT THE INVENTION

Figure 1:
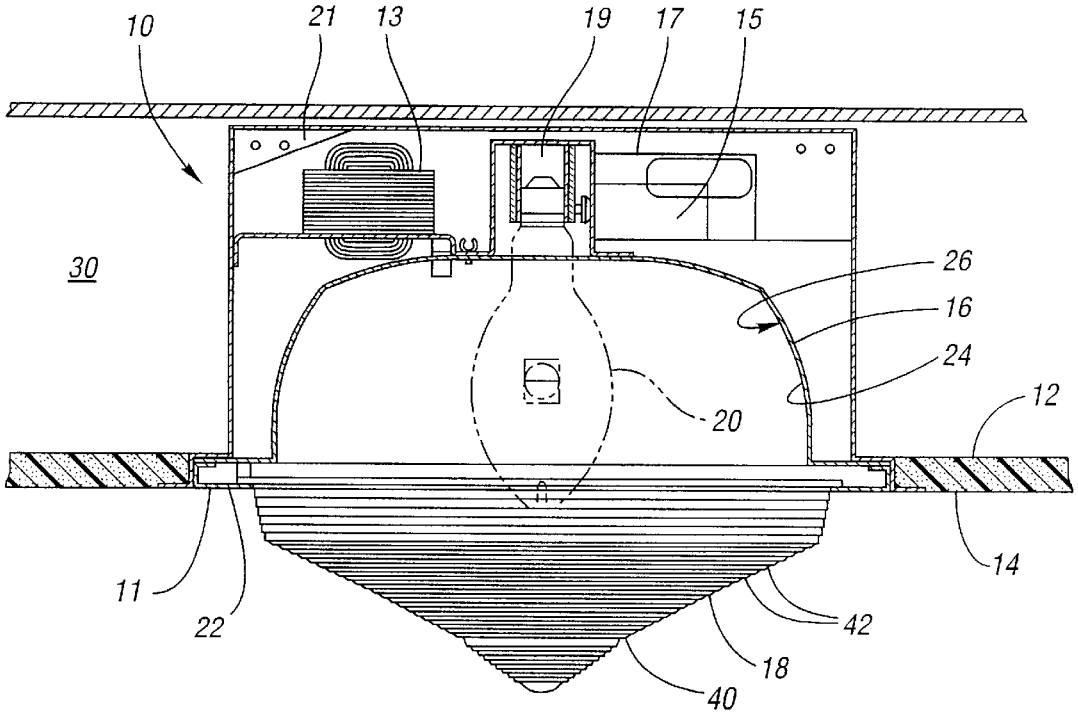
FIG. 1 is a side elevational view of a first embodiment of a luminaire assembly according to the present invention.
Figure 4:
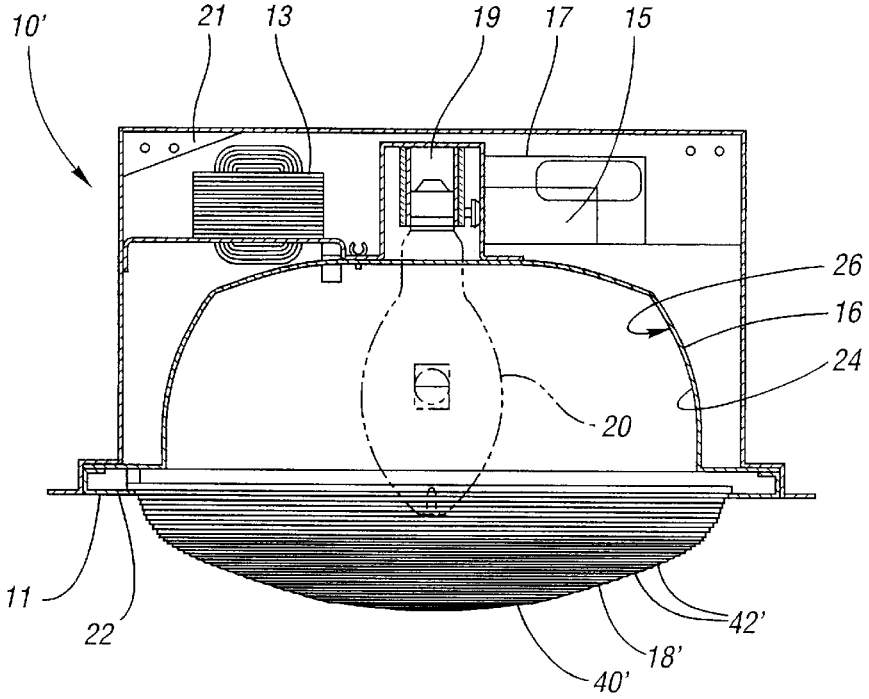
FIG. 4 is a perspective view of a second embodiment of a luminaire assembly according to the present invention having an alternative prismatic refractor design.

With reference to the drawings provided herein, FIG. 1 shows a luminaire assembly 10 according to the present invention. Luminaire assembly 10 has a frame 11 which is adapted for alignment and installation in a typical drop grid ceiling 12 which defines a substantially horizontal plane 14. As is further shown in FIG. 1, luminaire assembly 10 includes a reflector portion 16 and an optical unit 18 (also referred to herein as refractor portion 18). Reflector portion 16 is oriented substantially above horizontal plane 14. Optical unit 18 is similarly oriented substantially below horizontal plane 14. Also included in luminaire 10 is a high intensity discharge light source such as HID lamp 20. In keeping with the invention, lamp 20 may be vertically oriented substantially perpendicular to plane 14 for receipt and engagement in an electrical socket 19. Of course, any suitable orientation may be used depending on the application. Access means such as door 22 is provided in frame 11 to allow access to light source 20. As is well known in the art, HID light source 20 may be, for example, of the mercury, metal halide, high pressure sodium, or low pressure sodium types. FIG. 4 illustrates a second embodiment of a luminaire assembly 10' according to the present invention, wherein like components and features have like reference numerals with a prime (') designation. Thus, luminaire assembly 10' has a design similar to luminaire assembly 10 in FIG. 1 with an alternate optical unit/refractor 18' design.

According to the present invention, reflector portion 16 includes a highly reflective interior surface 24. In a preferred embodiment, surface 24 is a speculum or may be formed of a highly specular material 26 having a total specular reflectance on the order preferably of approximately 95%, and otherwise in a preferable range from 87–97%. A suitable material for reflector 16 is Miro 4™ manufactured by ALANOD Aluminium-Veredlung GmbH & Co., of Ennepetal, Germany. Miro 4™ has a tensile strength greater than or equal to 130 MPa; a yield strength of greater than or equal to 110 MPa; 2% elongation; a hardness of 37 on the Brinell scale; and a 12% diffuse reflection. The Miro 4™ is surface treated aluminum anodized with a flexible, reflection-reinforced layer using the physical vapor deposition (PVD) process. Of course, reflector 16 may be formed of any such material having the desired specular reflectance and other properties suitable for the desired application.

The reflectance property of interior surface 24 measures energy in the reflected beam regardless of the direction, while the specularity property of surface 24 refers to the overall shape of the reflected beam. Accordingly, highly specular materials or surfaces, such as surface 24, produce a sharp, narrow reflected beam, while diffuse materials known in the prior art would produce a blunt, broad reflected beam. Therefore, increased specular reflection of surface 24 improves directional beam control by reducing scattered light.

Figure 2A:
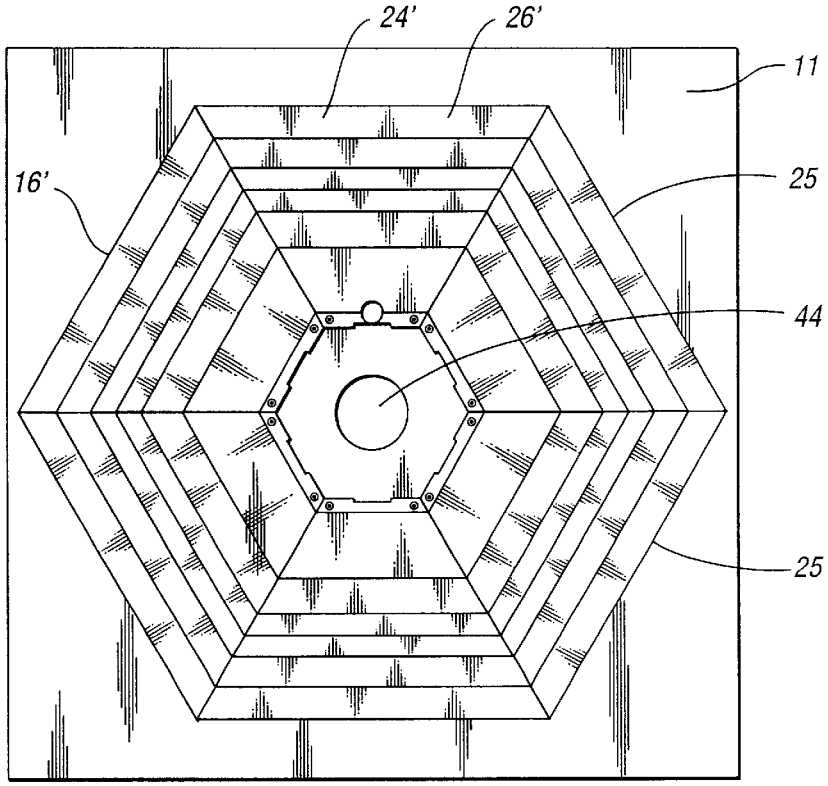
FIG. 2*a* is a bottom plan view of a spread beam distribution reflector formed of the specular material according to the present invention.
Figure 2B:
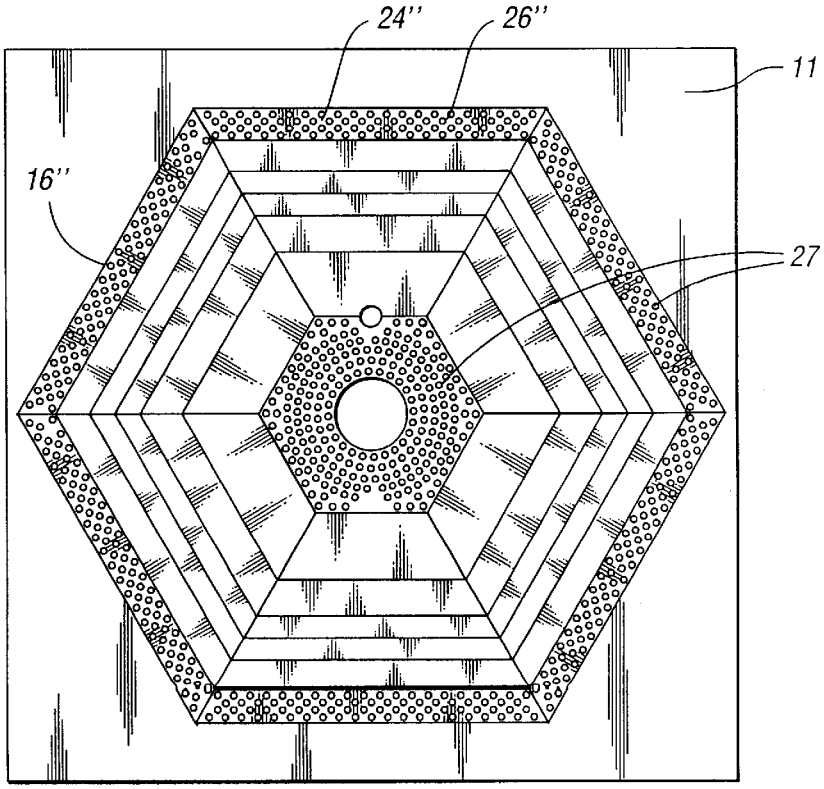
FIG. 2*b* is a bottom plan view of a task beam distribution reflector formed of the specular material according to the present invention.

As shown in FIGS. 2*a* and 2*b*, in another preferred embodiment, reflector 16 is formed of aluminum having the aforementioned highly specular surface 24 (particularly 24' and 24") which is faceted, having angles or bends formed therein. The embodiments shown in FIGS. 2*a* and 2*b* illustrate a segmented hexagonally shaped reflector (16', 16"), segments 25 attached together via interlocking tabs or other mechanical fastening means of joining such segments. It is contemplated, however, that reflector 16 may have any number of bends or segments formed therein as is feasible for the application and from a cost and manufacturing standpoint, such as octagonal, pentagonal, etc. While reflector 16 may be rolled or formed of a specular-coated circular spun aluminum design into reflector 16, the highly specular coating may also otherwise be deposited on the surface of the aluminum reflector 16. From a manufacturing standpoint the polygon faceting design feature is a less costly method of forming the preferred material into reflector 16. The segmented facets 25 serve to minimize glare, and further, a faceted, specular reflector 16 design allows precise beam control for drop glass refractor units.

Referring again to FIG. 1, optical unit 18 of luminaire assembly 10 is a prismatic refractor which is preferably formed of borosilicate glass. However, it is contemplated that optical unit 18 may also be formed of a plastic material having prisms 42 formed thereon (see also prisms 42' for optical unit 18' in FIG. 4). The material forming optical unit 18 has sufficient heat control properties or venting to control the heat generated by assembly 10. From an optical properties standpoint, the highly reflective interior surface 24 of reflector 16, in conjunction with prismatic refractor 18, provides for relatively high efficiency and low brightness. In keeping with the present invention, optical unit 18, 18' is disposed below reflector 16, thereby reducing and controlling the resultant brightness of surface 24, disclosed herein. Surface 24 also provides for improved and increased optical efficiency because more light from lamp 20 is able to exit luminaire assembly 10.

Luminaire assembly 10 according to the present invention, includes a highly specular surface 24 to increase luminaire efficiency. Efficiency is calculated according to the following formula:

$$Efficiency = Tran*(Direct+Indir*Refl^N)$$

where

Tran=Glass Transmission

Direct=Direction Radiation

Indir=Reflected Radiation

Refl=Material Reflection

N=Average Number of Reflections (Bounces)

For example, to ideally illustrate the advantages of the preferred surface 24 material over an anodized or white diffuse reflector and given Tran=0.92, Direct=0.35, Indir=0.65, Refl(Ano)=0.84, Refl(Miro4)=0.94, the results are provide in Table 1, below. Of course, these results are for comparison purposes only, as they assume ideal conditions, including uniform reflection and that all light rays go through the average number of bounces.

TABLE 1

| N | 1 | 2 | 3 | 4 | 5 | 6 |
|---|---|---|---|---|---|---|
| Anodized (Ano) | 82 | 74 | 68 | 62 | 57 | 53 |
| Miro4 | 88 | 85 | 82 | 79 | 76 | 73 |

% efficiency (assumes specular reflection)

Thus, as illustrated by Table 1, above, higher specular reflectance, such as the approximately 95% specular reflectance provided by surface 24, leads to a greater luminaire efficiency compared to prior art reflectors. Enhanced luminaire efficiency therefore yields fewer assemblies 10 necessary in operation for a designated area and desired lighting level. The highly specular and reflective material according to the present invention has been shown to provide an efficiency range from approximately 72 through 79% as shown in FIGS. 3*a*–3*d*, while the prior art white diffuse reflector material has a maximum efficiency of approximately 72%.

As indicated above, luminaire assembly 10 provides for an optimally minimum plenum depth for ceiling 12 into which luminaire assembly 10 is installed. In one embodiment, this plenum depth profile may be as low 12 inches. Such advantage is again provided by the highly specular surface 24 of luminaire assembly 10, which provides thermal advantages which allows for reduced plenum depths, whereas otherwise a lower ceiling would be necessary (i.e., relatively greater plenum depth). While typical indoor HID fixtures run at relatively high temperatures in enclosed spaces, luminaire assembly 10 according to the present invention includes highly specular surface 24 which reflects infrared light and keeps thermally sensitive electrical components—such as ballast 13 which supplies power to light source 20, a capacitor 15, and junction box 17—cooler, thereby protecting them from damage due to the higher temperatures. Thus, the desired specular reflectance (approximately 95%) of surface 24 of reflector 16 material leads to less heat conduction through the segmented panels 25 of reflector 16. The higher specular reflectance is contributed to by the high reflectance of surface 24 which leads to less absorption of radiation (approximately 5% absorbed each bounce) and by the specularity which reduces multiple bounces and thereby reduces overall absorption to the plenum area 30, junction box 17 and related components.

As shown in FIG. 1, luminaire assembly 10—and particularly refractor 18 and lamp 20) extends generally below plane 14 of ceiling 12 in a vertical orientation, without being accompanied by the high angle radiation or visual discomfort due to direct radiation from a lamp which would typically be associated with an indoor lighting fixture projecting below plane 14. As described above, the combination of highly specular reflector 16 and refractor 18 allows for precise optical control, allowing greater control (both low apparent brightness and lower fixture temperatures) over the high angle radiation that would cause the traditional discomfort. Furthermore, this combination allows junction box 17 to have a relatively lower profile than that of typical HID ceiling lighting fixtures. Thus, ceiling plenum depth 30 may be more shallow, thereby reducing expense and increasing the room height.

The high specular reflectance of surface 24 increases the overall efficiency of the fixture. The high reflectance property minimizes losses from reflector 16, while the specularity property helps control multiple bounces. The effect of multiple bounces can be seen in the Table 1. While typical fixtures range from 57–72% efficiency, luminaire 10 according to the present invention may range from 72–79% (see photometric diagrams of FIGS. 3*a,* 3*b*, 3*c* and 3*d*.) The enhanced efficiency means that, in many applications, relatively fewer fixtures 10 are necessary to achieve the same lighting levels in a desired application.

The reduction in apparent brightness of luminaire 10 is achieved through the precise control of optical radiation from lamp 20 (due to specular surface 24) and proper presentation of this optical radiation to refractor 18. In the white-coated diffuse material of the prior art, light impinging on refractor 18 would travel at a wide range of angles, leading to a lack of optical control through prismatic surfaces. Prisms 42 disposed on refractor 18 according to the present invention, are designed to achieve a specific refractive effect from a ray of a given incidence direction. Rays from other directions lead to unwanted stray light.

Figure 5:
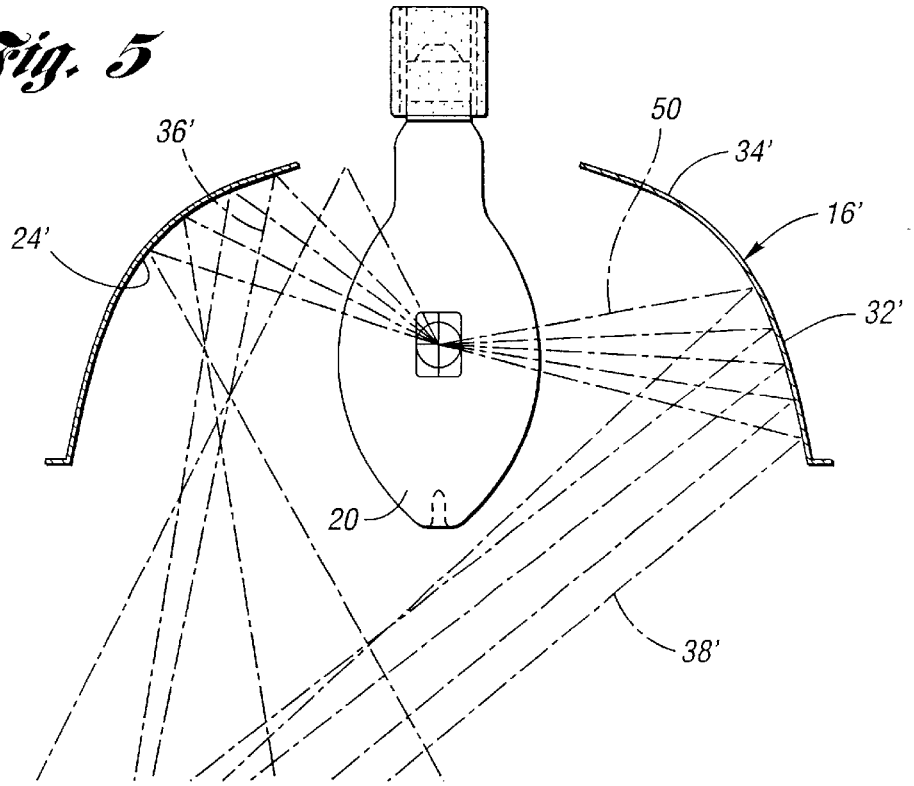
FIG. 5 is a raytracing diagram of a spread configuration for a spread beam reflector according to the present invention.
Figure 6:
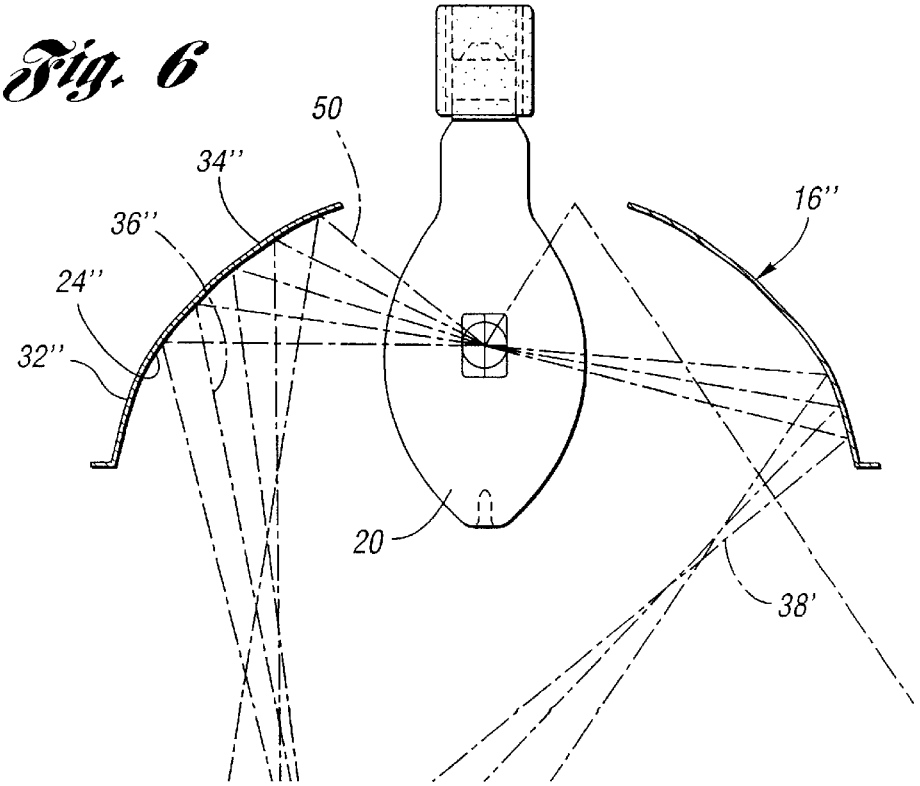
FIG. 6 is a raytracing diagram of a task configuration for a task beam reflector according to the present invention.

With reference now to FIGS. 5 and 6, shown therein are two alternative designs for reflector 16. FIG. 5 illustrates reflector 16' corresponding to the design type shown in FIG. 2*a,* while FIG. 6 illustrates reflector 16" corresponding to the design type shown in FIG. 2*b*. Each reflector 16', 16" is split into two zones: a lower zone (32', 32") for high angled beams and an upper zone (34', 34") for low angled beams. Specifically, FIG. 5 illustrates reflector 16' having a spread distribution which has relatively more high angle beam distribution, while reflector 16" of FIG. 6 has a task distribution which has relatively less high angle beam distribution.

Spread distribution (FIGS. 2*a* and 5) generally is preferable for wide spacings and lower mounting heights, while task distribution (FIGS. 2*b* and 6) is preferable for narrow spacings such as aisles, and provides concentrated light distribution patterns for higher mounting heights. For example, with the design of reflector 16' shown in FIG. 5, the low beams 36' are reflected at an angle between approximately 9–30°, while high beam 38' are distributed at an angle between approximately 48–53°. Whereas, reflector 16" of FIG. 6, has low beam 36" distribution between approximately 0–14° and high beam 38" distribution between approximately 34–52°. The angles listed for FIGS. 5 and 6 are vertical angles before entering prismatic refractor 18. In a preferred embodiment, it is the combination of this beam angle with the position of the incidence on the refractor that result in the high efficiency and lower brightness of luminaire assembly 10. Note in FIGS. 5 and 6 that reflectors 16', 16" each has a central aperture 44 formed therein for allowing a portion of light source 20 to pass therethrough. Referring to the task reflector 16" of FIG. 2*b*, the material 26" forming surface 24" may also include a partial or completely textured or patterned surface 27 in order to assist in achieving the goal desired through use of the task reflector 16" as previously disclosed.

Light rays 50 are emitted from light source 20 and strike specular reflector surface 24, which light rays are then reflected thereby as exiting reflected rays 36', 36", 38', 38". The curved design of the lower portion of refractor 18, 18' (not shown in FIGS. 5–6)—and particularly the tapered shape of the lower portion 40, 40' (shown in FIGS. 1 and 4, respectively)—allows the emitted rays from light source 20 to be redirected to aforementioned lower angles, thus preventing greater refractive action.

In typical luminaires, shallow ceilings can present not only problems with size limitations of luminaire 10 or junction box 17, but also the reduced volume can lead to higher ambient temperatures. Typical HID units may allow a relatively large amount of heat to escape to the ceiling plenum area 30 which may affect thermally sensitive components. Luminaire 10, on the other hand, includes highly specular surface 24 as disclosed herein which leads to higher luminaire 10 efficiency and also serves to reflect more infrared radiation, leading to a reduction in temperatures for thermally sensitive components (such as junction box 17, capacitor 15 and ballast 13 attached to housing 21). In comparing temperatures of a white diffuse reflector surface (Tw) to a specular reflector surface (Tm) according to the present invention, having similar shapes in order to quantify the thermal advantages, preliminary testing has shown the average temperature differences (Avg (Tw–Tm) in ° C.) provided for each set of luminaire components as shown in Table 2. The reduced temperatures of specular surface 24 of luminaire assembly 10 allow assembly 10 to achieve a UL minimum 0.5" clearance above junction box 17.

TABLE 2

| | All | Electrical Components | Reflector | Housing | Environment |
|---|---|---|---|---|---|
| Avg(Tw-Tm) | 7.3 | 8.5 | 18.2 | 6.1 | 5.2 |

With reference to FIGS. 1 and 4 note that various refractor embodiments are shown and designated as refractor 18 and 18'. Such refractors 18 may be interchangeable, thereby allowing for the ease of changing lighting distribution patterns. In traditional HID fixtures, in order to change the lighting distribution one must change the lamp 20 center and/or the optical unit 18 itself. However, in keeping with the present invention, it is noted that reflector 16 itself may be changed to another polygonal geometric array (hexagonal, etc.) or segmented design in order to change the lighting distribution of luminaire assembly 10. It is contemplated that the teachings disclosed herein may be used with incandescent lamps, which at high wattages, appear to have the same heat considerations as with the HID lamps.

Figure 3B:
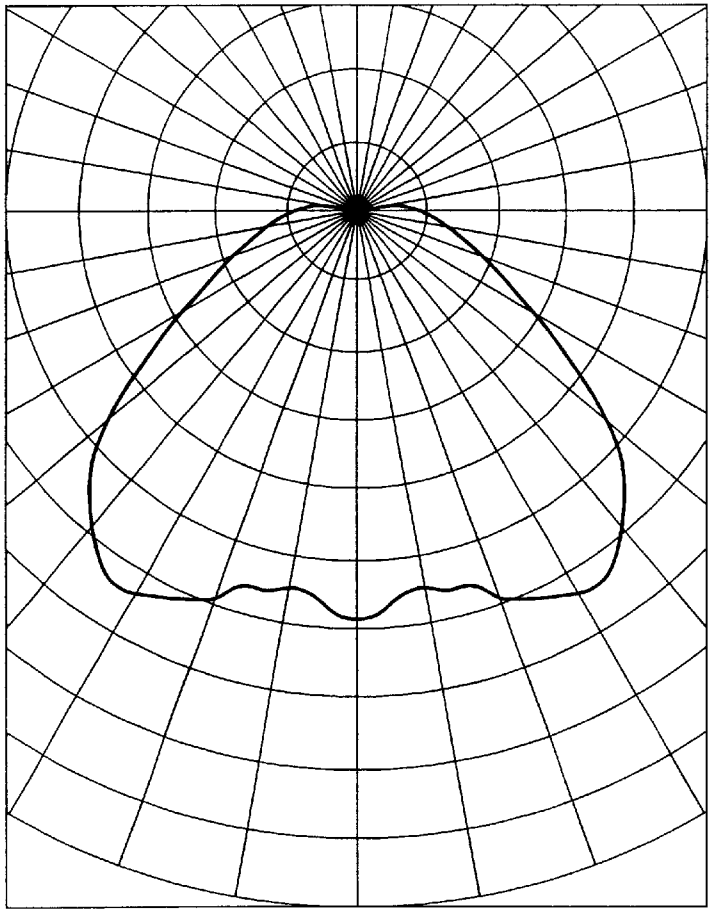
FIG. 3*b* illustrates a typical photometric candlepower distribution curve for a luminaire assembly having a refractor similar to that shown in FIG. 4, with a spread beam reflector.
Figure 3A:
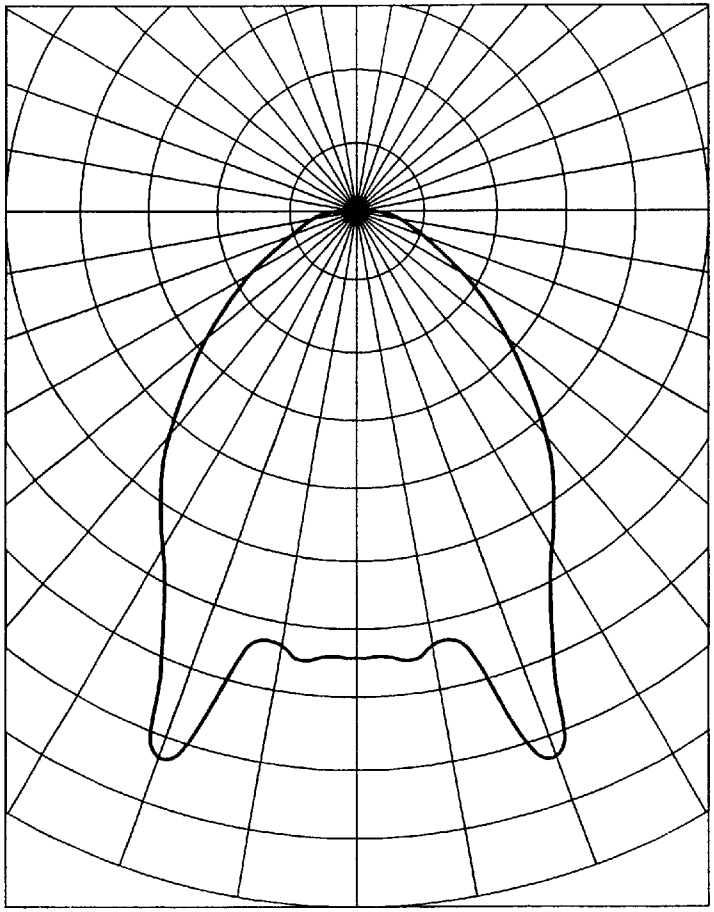
FIG. 3*a* illustrates a typical photometric candlepower distribution curve for a luminaire assembly having a refractor similar to that shown in FIG. 4 with task beam reflector.
Figure 3B:
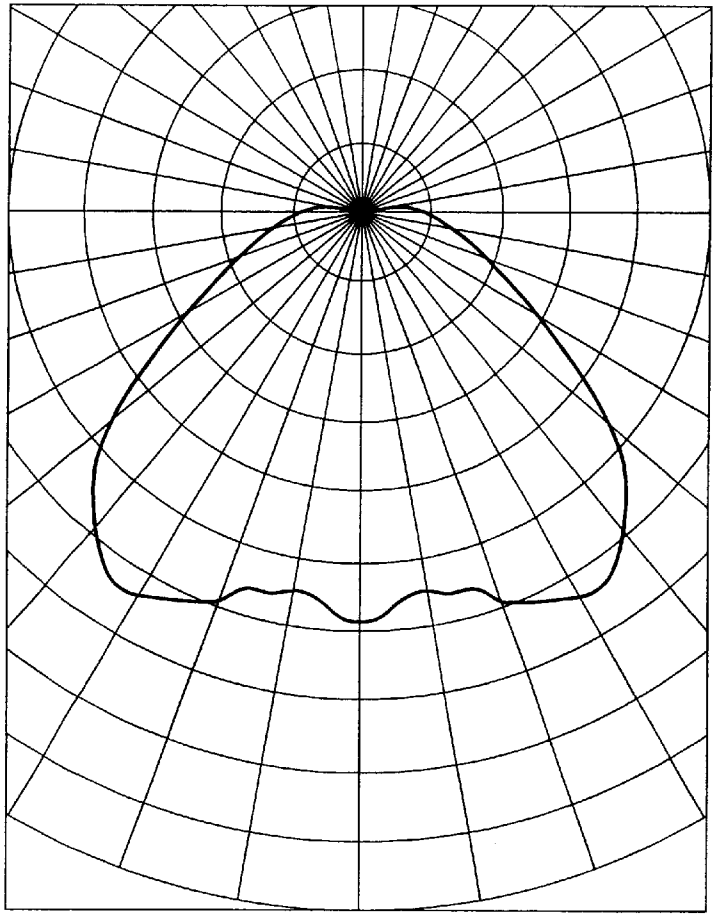
Figure 3C:
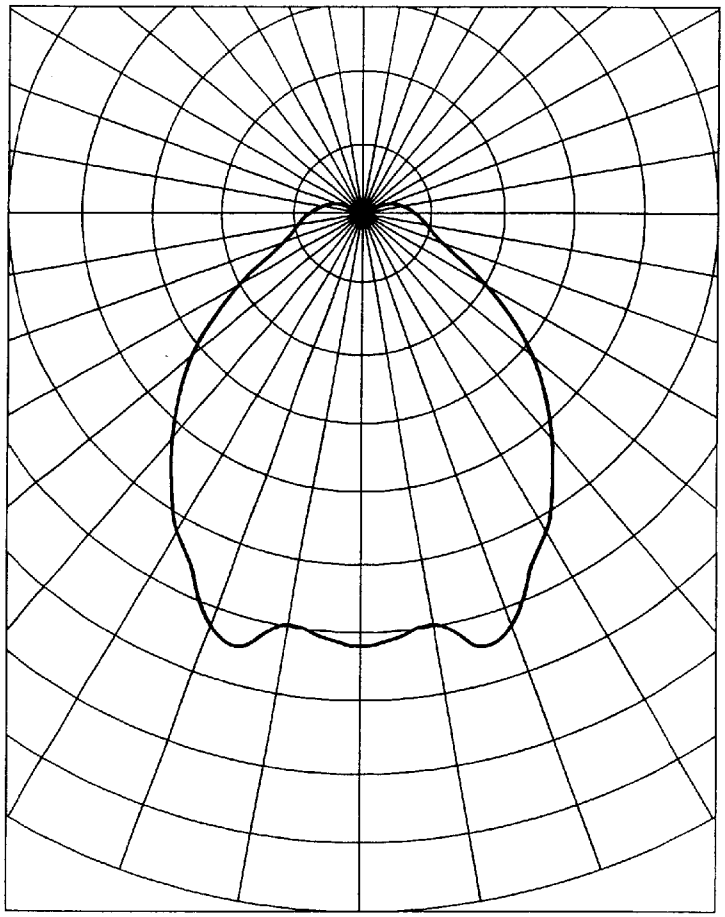
FIG. 3*c* illustrates a typical photometric candlepower distribution curve for a luminaire assembly having a refractor similar to that shown in FIG. 1, with a task beam reflector.

FIGS. 3*a*, 3*b*, 3*c* and 3*d* illustrate typical photometric candlepower distribution curves for various embodiments of luminaire assembly 10 according to the present invention. As shown therein, FIG. 3*a* illustrates a typical photometric candlepower distribution curve for a luminaire assembly having a refractor similar to that shown in FIG. 4 with the task beam reflector of FIG. 2*b* (shown with an efficiency of 72.2%); FIG. 3*b* illustrates a typical photometric candlepower distribution curve for a luminaire assembly having a refractor similar to that shown in FIG. 4, with a spread beam reflector of FIG. 2*a* (shown with an efficiency of 79.0%); FIG. 3*c* illustrates a typical photometric candlepower distribution curve for a luminaire assembly having a refractor similar to that shown in FIG. 1, with a task beam reflector of FIG. 2*b* (shown with an efficiency of 74.3%); and FIG. 3*d* illustrates a typical photometric candlepower distribution curve for a luminaire assembly having a refractor similar to that shown in FIG. 1, with a spread beam reflector of FIG. 2*a* (shown with an efficiency of 79.0%).

The candlepower distribution of luminaires assembly 10 according to the present invention allows adjacent luminaires to be spaced farther apart, thus requiring fewer luminaire assemblies per designated area. Thus, the desired distribution of light is achieved by the operation of reflector 16 and refractor 22.

It is understood, of course, that while the forms of the invention herein shown and described include the best mode contemplated for carrying out the present invention, they are not intended to illustrate all possible forms thereof. It will also be understood that the words used are descriptive rather than limiting, and that various changes may be made without departing from the spirit or scope of the invention as claimed below.

What is claimed is:

1. An indoor recessed luminaire assembly for installation in a drop ceiling defining a ceiling plane, the indoor luminaire assembly comprising:

a housing oriented above the drop ceiling plane and having a lamp socket, a ballast and a capacitor mounted therein;

a lamp received in the lamp socket and vertically disposed therefrom for generating light, the lamp projecting below the ceiling plane;

a frame disposed in the drop ceiling co-planar with the ceiling plane;

a reflector disposed above the ceiling plane, attached to the frame, and having a relatively high specular reflective inner surface; and a glass prismatic optical unit attached to the frame and disposed below the plane of the drop ceiling for distributing generated light, wherein the indoor recessed luminaire assembly has an efficiency in the range of 72–79%.

2. The indoor recessed luminaire assembly of claim 1 wherein the reflector is formed of an aluminum material having a specular material deposited on at least one side thereof defining the high specular reflective inner surface.

3. The indoor recessed luminaire assembly of claim 1 wherein the reflector is formed of faceted segments attached to each other.

4. The indoor recessed luminaire assembly of claim 3 wherein the faceted segments define a segmented hexagonal shape.

* * * * *